United States Patent [19]

Bruder et al.

[11] 4,400,597

[45] Aug. 23, 1983

[54] AXIAL CAM ROTARY SWITCH

[75] Inventors: Frank J. Bruder, Newport Beach; Robert D. Taylor, Lakewood, both of Calif.

[73] Assignee: EECO Incorporated, Santa Ana, Calif.

[21] Appl. No.: 349,406

[22] Filed: Feb. 16, 1982

[51] Int. Cl.[3] ..... H01H 19/60

[52] U.S. Cl. ..... 200/6 B; 200/6 BB; 200/11 G; 200/11 K; 200/291; 200/302

[58] Field of Search ..... 200/6 B, 6 BB, 6 C, 200/11 E, 11 EA, 11 G, 11 J, 11 TW, 290, 291, 302, 307

[56] References Cited

U.S. PATENT DOCUMENTS

| | | | |
|---|---|---|---|
| 2,908,777 | 10/1959 | Brown | 200/11 J |
| 3,281,552 | 10/1966 | Tennant | 200/11 EA X |
| 3,395,260 | 7/1968 | Hamlin | 200/302 |
| 3,596,013 | 7/1971 | Pihl | 200/11 EA |
| 3,903,383 | 9/1975 | Marker | 200/11 TW |
| 4,133,990 | 1/1979 | Wanner et al. | 200/6 B |
| 4,267,412 | 5/1981 | Janssen et al. | 200/6 B |

*Primary Examiner*—J. R. Scott

*Attorney, Agent, or Firm*—Harry R. Lubcke

[57] ABSTRACT

A rotary switch having a multiple throw axial cam rotor and operatively aligned detent teeth. One held stationary contact spring spider has plural radially disposed axially-movable cam follower switch contact arms engaging the axial cam, and also has plural detent springs engaging the axial detent teeth. A base has stationary contacts to be selectively engaged by the switch contacts, and a journal post upon which the rotor is rotatable. An externally accessible shaft upon the rotor has a surrounding resilient "O" ring. A housing sealed to the base and bearing upon the "O" ring seals the switch. The switch may be fabricated in DIP size and contact configuration.

8 Claims, 8 Drawing Figures

AXIAL CAM ROTARY SWITCH

BACKGROUND OF THE INVENTION

This invention pertains to a manually rotatable multi-position electrical switch of small size.

Janssen et al., U.S. Pat. No. 4,267,412, discloses such a switch having separate compound contacts that ride upon an axial cam, or in a groove-cam. The switch does not have a shaft, but has two major parts that are peripherally related to allow rotation. Spaced peripheral indexing of the switch position is used. The switch cannot be sealed.

Wanner et al., U.S. Pat. No. 4,133,990, discloses a switch with axial cams on both sides of a rotor, but with plural parallel-disposed linear finger contacts having "elbow" bends to ride upon the cams for actuating the switching mechanism. Detenting or sealing the switch are not mentioned.

Hamlin, U.S. Pat. No. 3,395,260, discloses a rotary switch structure in which an "O" ring seals only the shaft to a panel upon which the switch may be mounted. A specific pressure plate bearing upon the "O" ring, with a bracket and screws to exert pressure upon the plate are used; an involved structure.

Marker, U.S. Pat. No. 3,903,383, discloses axial detent serrations that slip over other serrations by axial displacement of the rotor. Plural contact spring fingers bear upon a printed-circuit-board rotor to allow this slippage.

Sealing the switch is not mentioned.

BRIEF SUMMARY OF THE INVENTION

A small rotary switch has a multiple throw axial cam rotor and operatively aligned detent teeth. One stationary spring spider has plural radially disposed axially-movable cam-follower switch contact arms that are substantially coplanar with the spider and selectively engage lobes of the axial cam upon rotation of the rotor. The spider also has plural opposed integral detent springs that engage the axial detent teeth.

A base has symmetrically arranged stationary contacts that are selectively contacted by the switch contact arms upon the displacement thereof by the lobes of the axial cam.

A shaft upon the rotor has a surrounding "O" ring.

A housing is sealed to the base and is so dimensioned that it concomitantly bears upon the "O" ring to thereby seal the switch.

DETAILED DESCRIPTION OF THE PREFERRED EMBODIMENTS

Figures 1, 2:
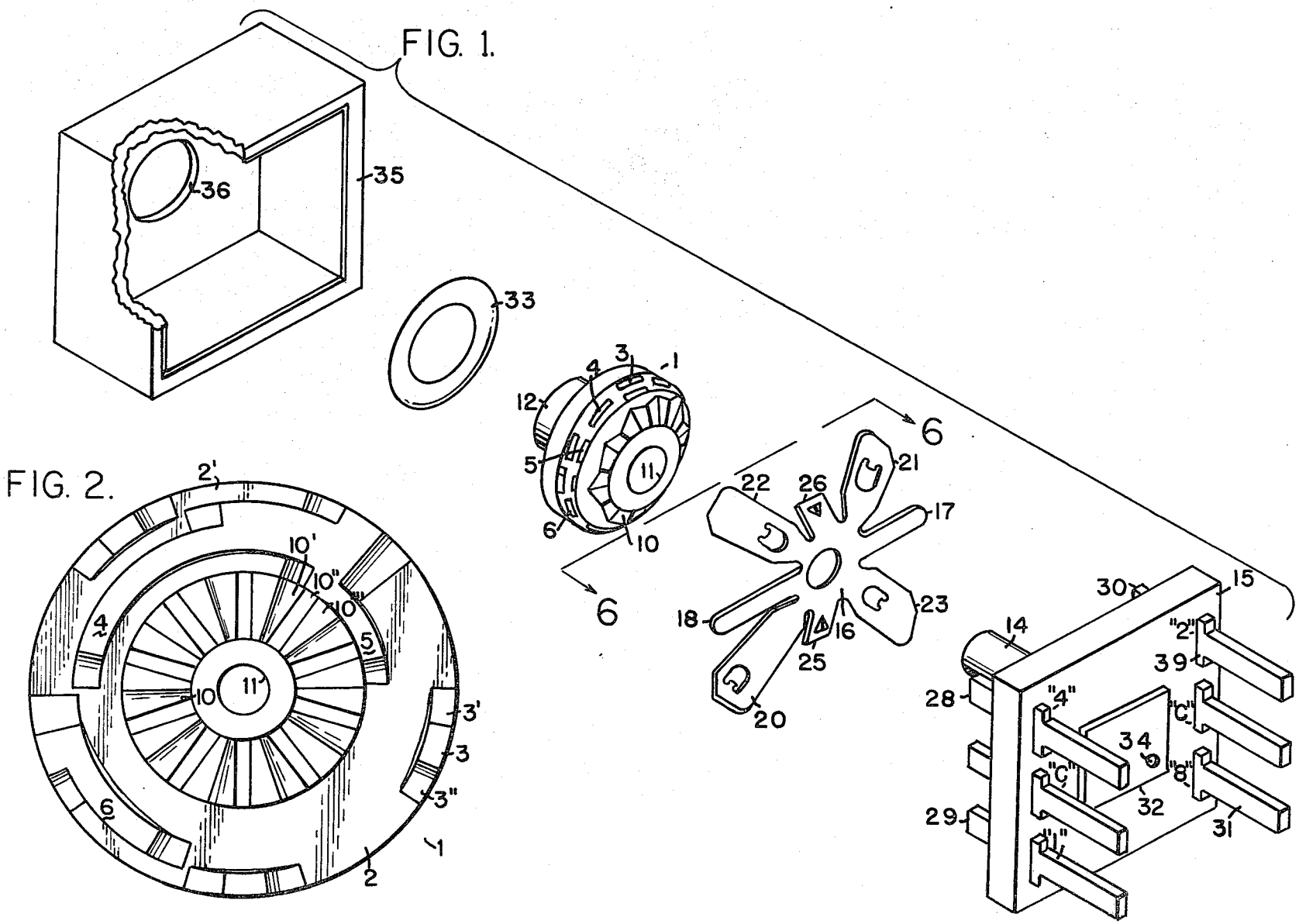
FIG. 1 is an exploded view of the switch, in perspective.
FIG. 2 is a bottom view of the rotor, showing the axial cam and the detent teeth.

In FIG. 1, rotor 1 is comprised of axial cam 2, having, for example, lobes 3, 4, 5 and 6, and an inner circumference of relatively axially oriented detent teeth 10. A central aperture 11 passes through the axial extent of the rotor except for the upper part of shaft 12, which shaft extends from the rotor on the side away from cam 2. Shaft 12 is the manual operating element, typically operable with a screw-driver.

The number and placement of the cam lobes depends upon the mode of switching desired. The lobes shown in FIG. 2 accomplish switching in a binary coded pattern.

TABLE I

| POSITION | VALUE TERMINAL | 1 (29) | 2 (30) | 4 (28) | 8 (31) |
|---|---|---|---|---|---|
| 0 | | | | | |
| 1 | | o | | | |
| 2 | | | o | | |
| 3 | | o | o | | |
| 4 | | | | o | |
| 5 | | o | | o | |
| 6 | | | o | o | |
| 7 | | o | o | o | |
| 8 | | | | | o |
| 9 | | o | | | o |

In Table I, "o"=common (spider 16) connected to the terminal indicated.

Figure 8:
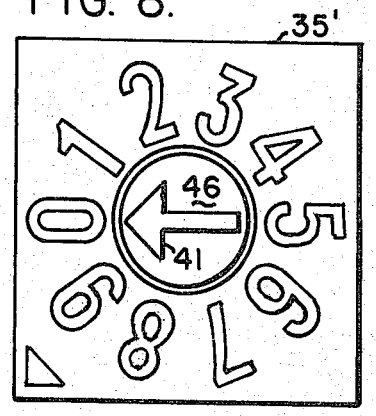
FIG. 8 is a front elevation view of the same.

In TABLE I the ten positions of the switch, note FIG. 8, are listed vertically in the first column. The further vertical columns list the stationary contacts. Contact 29 has a binary value of "1," contact 30 has a value of "2," contact 28 has a value of "4," and contact 31 has a value of "8." See FIG. 6 for the positions of these stationary contacts.

The "o"s in the table signify a closed circuit between the stationary contact involved and the common electrical connection "C" to spider 16. The spider is electrically and mechanically connected to the "C" contacts by welding or soldering extensions 17 and 18 thereof to them. The external circuit is thus completed through the "C" contact terminals and the adjacent external terminal in the group of "1" through "8."

Certain binary values, such as "1," "2," "4" and "8" are provided by one contact being made by one, 20 through 23, arm of the common connection "C" spider 16, while others are provided by contact being simultaneously made by two arms, as 20 and 21, giving "1"+"2"="3;" "1"+"4"="5," etc. Seven is obtained by simultaneously contacting "1," "2" and "4."

Another illustrative code is the "complement code", which is the exact opposite of the above binary coded (decimal) structure. That is, where there is an electrical contact being made as indicated in Table I, above, an electrical contact is not being made there with the complement code.

Also integrally a part of the one contact spring spider 16 are detent springs 25 and 26. These are positioned opposite one another so that the pressure exerted by them is balanced with respect to the rotor, and there is no tendency toward asymmetric wear upon central aperture 11 and journal post 14 of base 15, upon which post the rotor is rotatable.

Detent teeth 10 are molded into rotor 1 at an angle to the axis of the rotor of approximately 10°, and at a smaller radius than that of axial cam 2.

Detent springs 25 and 26 are bent toward these teeth. The springs each have a "coffee-pot-spout" depression at each extremity of the springs, which fits into the valleys of teeth 10. The proportions are such that the "spouts" always slip into the valleys and the detenting is certain and precise.

Beryllium copper is the preferred material for spring spider 16. Lack of fatigue and lack of grain direction are factors.

Journal post 14, base 15, and rotor 1 are preferably fabricated of a glass-filled polyester, perhaps 30% glass-filled. These parts can be fabricated to a tolerance of 0.01 millimeter (mm) and will remain in precise fit for many thousands of operations.

Stationary contacts 29 to 31 and both "C" contacts may be fabricated of flat phosphor bronze and are pushed into snug-fit holes in base 15. These extend into the inner space of the base a uniform amount, to make contact with cam-follower switch arms 20 to 23 on a selective basis.

These stationary contacts may alternately be cylindrical.

In either event, a spacing portion, as 39, extends down from the under-surface of base 15 on each stationary contact. These extensions provide stand-off positioning for the completed switch from the printed-circuit-board upon which it is typically mounted. This is usually approximately 0.4 mm, and is to allow solvent cleaning of soldering flux or other material from between the top of the circuit-board and the bottom of the switch.

Importantly, the stationary contacts extend from the base in a uniform symmetrical pattern, typically according to the universal world-wide printed-circuit-board hole spacing of 0.1 inch (2.54 mm), and electively, of DIP configuration.

The stationary contacts are preferably gold plated upon the tops, while the switch arms are gold plated on the under sides, so that gold to gold contact is made. These contacts are also normally tin or solder plated on the portions exterior to the base to facilitate soldering connections thereto.

Figure 3:
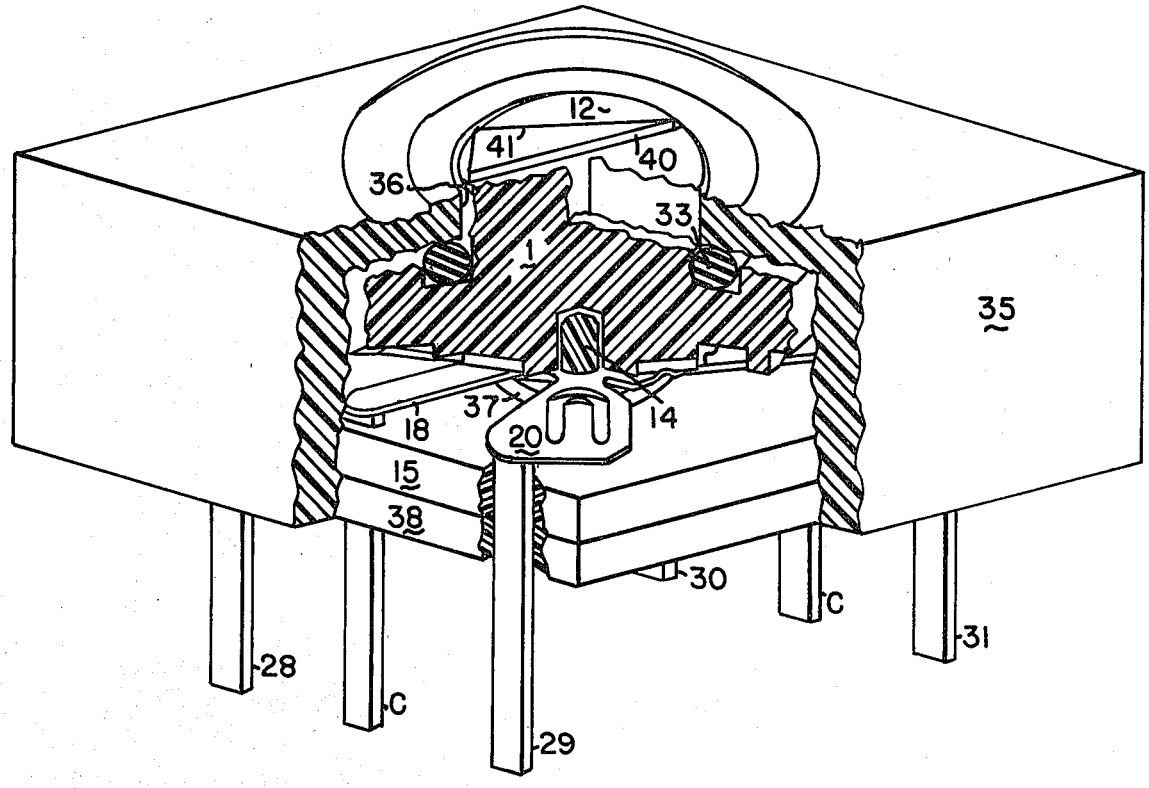
FIG. 3 is an assembled view of the switch, with the front quarter broken away to show the construction, in perspective.

The switch is assembled by placing spider 16 down upon journal post 14, to rest upon shoulder 37 (shown in FIG. 3). Rotor 1 is next placed upon the journal post. An "O" ring 33 of an inner diameter to fit snugly around shaft 12 is placed upon that shaft.

Switch housing 35 is a hollow rectangular parallelopiped without a bottom and with an aperture 36 in the top wall of a diameter just large enough to receive shaft 12. The housing is typically fabricated of glass-filled polyester, as was the base.

The several parts are proportioned axially so that when all are assembled, with housing 35 over and extending slightly below base 15, "O" ring 33 is sufficiently compressed to seal shaft 12 with respect to aperture 36.

Thereafter, epoxy resin 38 is placed upon the bottom of base 15, and the same cured, preferably at an elevated temperature. The epoxy can be placed over the whole under-side of base 15, or, as shown in FIG. 1, a central rectangular "island" 32 may be cast upon base 15, having a thickness equal to the desired thickness of the epoxy. This is approximately 1 mm for a switch of DIP size. An aperture 34 is provided in the island through to the interior of the switch to allow air to escape during the epoxy sealing curing process. The aperture is subsequently sealed with room-temperature curing epoxy to provide a fully sealed switch. A diameter of 0.5 mm is suitable for aperture 38.

FIG. 2 is a bottom view of the rotor, showing the axial cam and the detent teeth. The surface shaded areas 2, 2', etc. represent the base of the axial cam, without lobes; so that when any of the cam-follower switch arms 20 through 23 are resting upon this base area, the switch contacts are open. Contrarywise, when switch arm 20 is upon cam lobe 3, it mechanically and electrically contacts stationary contact 29, and a binary "1" connection is made.

At other rotary positions of rotor 1 other contacts are made, as has been set forth in Table I.

Detent teeth 10 each have a rising portion 10', a narrow flat portion 10'' and a descending portion 10'''.

Similarly, each cam lobe, as 3, has a ramp up 3', the raised lobe 3, and a ramp down 3''.

Figure 4:
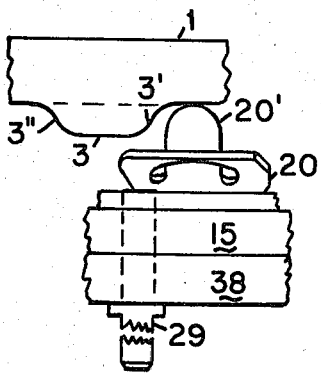
FIG. 4 is a fragmentary view of the switch of FIG. 3, showing one contact in the open position.
Figure 6:
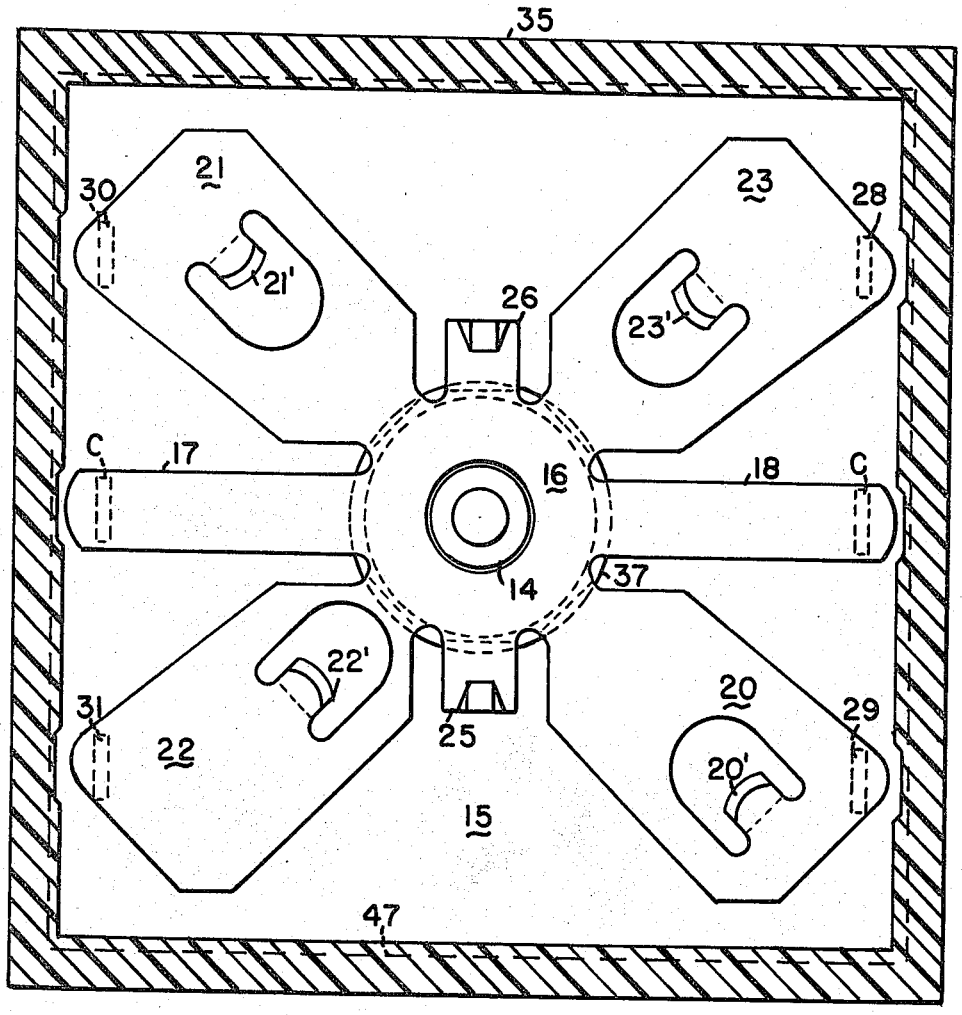
FIG. 6 is a top plan view, along line 6—6 in FIG. 1, showing the stationary spring spider and the base.

The lobe detail is shown in elevation in FIG. 4. The contact is shown in the electrically open position. Cam 3 is not bearing down upon cam-follower switch arm 20. Cam-follower tab 20' is seen to actually ride upon the cam surface and the lobes, as the case may be. This tab is cut from the follower on three sides and then bent substantially at right angles to it to ride upon the circumference where the lobes that actuate that follower are to be found. Referring to FIGS. 1, 2 and 6, it is seen that each follower tab has a different radial position.

Figure 5:
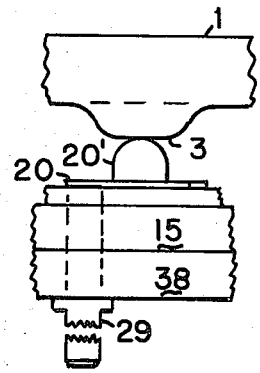
FIG. 5 is the same, but showing the one contact of FIG. 4 in the closed position.

FIG. 5 is a duplicate of FIG. 4, except that rotor 1 has moved to the right sufficiently to depress tab 20' by means of axial cam 3 and so cam-follower switch arm 20 is down against contact 29, closing the electrical circuit between common C spider 16 connection and contact 29.

The general assembly of the switch is shown in the one-quarter broken away elevation perspective view of FIG. 3.

The various parts shown in the exploded perspective view of FIG. 1 are shown assembled in FIG. 3. Cam-follower switch arm is shown depressed, making mechanical and electrical contact with stationary contact 29, although the cam lobe is absent because of the broken away view of FIG. 3.

This embodiment of the switch is the flush type. Shaft 12 is terminated at the upper surface of housing 35. Half of screw-driver slot 40 and half of indicating arrow 41 are shown on the top surface of shaft 12.

The epoxy sealing layer 38 is shown below base 15.

Common arm 18 of the spider is shown welded to the adjacent stationary terminal C.

The plan view of FIG. 6 shows the proportions of the spider 16 and its relation to base 15; this being along line 6—6 in FIG. 1.

Square base 15 has shoulder 37 to incrementally space the spider from the upper surface of the base. This insures certain contact of switch arms 20 through 23 to stationary contacts 28 through 31, respectively, upon actuation downward of a switch arm by a cam lobe.

Cam-follower tab 20' is at the largest radius from post 14. This causes actuation thereof by outer cam lobes, such as lobe 3. Cam-follower tab 21' is at a smaller radius than that of tab 20' and so is actuated by cam lobes in the next inner circumference on cam 2, such as lobe 6. Cam follower tab 23' is at an even smaller radius and so is actuated by cam lobes at that even smaller radius, such as lobe 4. Cam-follower tab 22' is at the smallest radius and so is actuated by cam lobes at the smallest radius, such as lobe 5. See FIG. 2 for the lobe radii.

Further in FIG. 6, detent springs 25 and 26, oppositely disposed, are bent upward so that the coffee-pot-spout depression at the extremity of each will engage the 10° angled detent teeth 10, as was previously noted in connection with FIG. 1.

Outer dotted line 47 represents a step in the housing that locates the base assembly.

Figure 7:
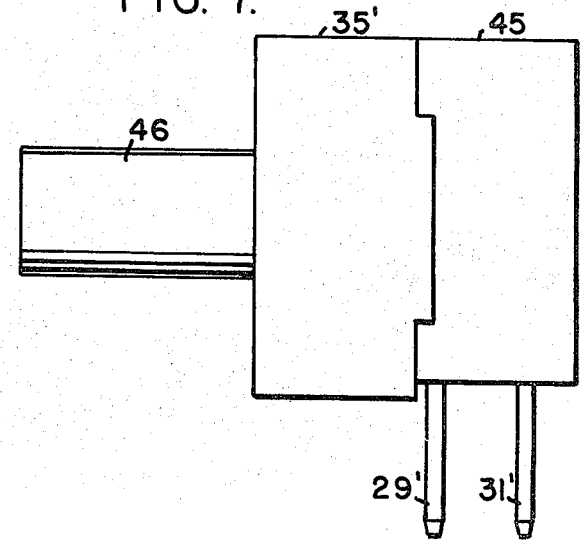
FIG. 7 is a side elevation view of a side-adjust alternate embodiment of the switch.

FIG. 7 is a side elevation view of an alternate embodiment of the switch. In effect, the switch is mounted with the actuating axis horizontal, rather than vertical, as in FIG. 3. In use, this allows edge of circuit card adjustment rather than adjustment at right angles to a circuit card, as is required for the embodiment of FIG. 3.

Square parallelopiped housing 35' is the equivalent of housing 35 of FIG. 3, and it contains the switch elements as before. Mating further-housing 45 contains the six external connections 28 through 31 and the two common "C" connections. These are now longer and are bent at right angles exterior to the switch elements, to emerge as 29' and 31' as seen in FIG. 7.

Further-housing 45 is raised where the connections emerge to allow flux, etc to be cleaned away, as before.

Shaft 46 of FIG. 7 is merely an extension of shaft 12 of FIG. 1. Typically it is formed integrally to shaft 12.

FIG. 8 is a front elevation view of the embodiment of FIG. 7. It is also a front elevation view of the embodiment of FIG. 1, save for the addition of a screw-driver slot 40, as seen in FIG. 3. In either embodiment shaft 12 or 46 has arrow indicator 41.

Shaft 46 can be substituted for shaft 12 in FIGS. 1 and 3, to give finger rather than screw-driver adjustment.

Typically, numerals "0" through "9" are arranged radially around the rotor shaft; preferably by being molded in the the housing, either raised or depressed. These correspond to the numerals in Table I.

We claim:

1. A rotary switch, comprising;

(a) a rotor (1), having an axial cam (2) with plural lobes (3–6) at plural radii, and also axial-detent teeth (10) operatively aligned with said lobes, (b) one stationary electrically-conductive contact spring spider (16), having plural radially outwardly projecting axially-movable cam-follower switch arms (20–23) substantially coplanar with said spider to selectively engage said lobes upon rotation of said rotor, said one spring spider also having plural integral detent springs (25,26) engaging said axial-detent teeth, (c) an insulative base (15) having stationary electrically-conductive contacts (28–31) passing through said base in a rectilinear pattern and disposed to be selectively engaged by said switch arms upon axial displacement thereof by said lobes upon rotation of said rotor, (d) an insulative shaft (12) integral with said rotor, (e) a resilient "O" ring (33) surrounding said shaft, and (f) an insulative housing (35) sealed to said base and mechanically bearing upon said "O" ring a substantially constant amount to seal said rotary switch.

2. The rotary switch of claim 1, in which;

(a) said base has an integrally-formed journal post (14) upon which said rotor (1) is rotatable.

3. The rotary switch of claim 1, in which;

(a) said axial-detent teeth are disposed at a smaller radius than any of the radii of said lobes of the axial cam.

4. The rotary switch of claim 1, in which;

(a) said axial-detent teeth are disposed at an acute angle to the axis of the rotor.

5. The rotary switch of claim 1, in which;

(a) said contact spring spider (16) is clamped to said base below said rotor by pressure from said "O" ring.

6. The rotary switch of claim 1, in which;

(a) said contact spring spider (16) has at least one permanent electrical connection passing through said base.

7. The rotary switch of claim 1, in which;

(a) said stationary contacts that pass through said base are printed-circuit-board contacts and are disposed in a universal printed-circuit-board spacing pattern.

8. The rotary switch of claim 1, which additionally includes;

(a) a further-housing (45) symmetrically fastened to said housing (35), and (b) containing only external connections (28'–31') from said stationary contacts (28–31) that pass through one side of said further-housing at right angles to said stationary contacts.

* * * * *